US007814989B2

(12) United States Patent
Nikolakis-Mouchas et al.

(10) Patent No.: US 7,814,989 B2
(45) Date of Patent: Oct. 19, 2010

(54) SYSTEM AND METHOD FOR PERFORMING A DRILLING OPERATION IN AN OILFIELD

(75) Inventors: Christos Nikolakis-Mouchas, Houston, TX (US); Vivek Singh, Houston, TX (US); Dmitriy Repin, Katy, TX (US); Clinton Chapman, Missouri City, TX (US)

(73) Assignee: Schlumberger Technology Corporation, Houston, TX (US)

( * ) Notice: Subject to any disclaimer, the term of this patent is extended or adjusted under 35 U.S.C. 154(b) by 161 days.

(21) Appl. No.: 12/124,049

(22) Filed: May 20, 2008

(65) Prior Publication Data

US 2008/0289877 A1 Nov. 27, 2008

Related U.S. Application Data

(60) Provisional application No. 60/931,063, filed on May 21, 2007.

(51) Int. Cl.
*E21B 47/022* (2006.01)
*E21B 7/04* (2006.01)

(52) U.S. Cl. ..... 175/45; 175/61; 702/9

(58) Field of Classification Search ..... 175/61, 175/62, 40, 45, 50; 702/9
See application file for complete search history.

(56) References Cited

U.S. PATENT DOCUMENTS 4,957,172 A * 9/1990 Patton et al. ..... 175/61
5,064,006 A * 11/1991 Waters et al. ..... 175/45
5,139,094 A 8/1992 Prevedel et al.
5,517,464 A 5/1996 Lerner et al.
5,680,906 A 10/1997 Andrieux et al.
5,812,068 A * 9/1998 Wisler et al. ..... 340/855.5
5,895,437 A * 4/1999 Di Cesare et al. ..... 702/9
5,899,958 A 5/1999 Dowell et al.
5,901,795 A * 5/1999 Tsao et al. ..... 175/45
5,992,519 A 11/1999 Ramakrishnan et al.
6,109,370 A * 8/2000 Gray ..... 175/61
6,155,357 A 12/2000 King et al.
6,266,619 B1 7/2001 Thomas et al.
6,313,837 B1 11/2001 Assa et al.

(Continued)

FOREIGN PATENT DOCUMENTS

GB 2392931 3/2004

(Continued)

OTHER PUBLICATIONS

International Search Report dated Sep. 29, 2008 (3 pages).

*Primary Examiner*—Kenneth Thompson
(74) *Attorney, Agent, or Firm*—Robert P Lord; Cuong Lam Nguyen; Bryan P. Galloway

(57) ABSTRACT

The invention relates to a method for performing a drilling operation at a wellsite having a drilling rig configured to advance a drilling tool into a subsurface. The method steps include obtaining a well trajectory associated with a first volume, obtaining information related to a first subsurface entity associated with a second volume, using a three-dimensional relational comparison to determine that the first volume intersects the second volume to define a first intersection information, updating the well trajectory, based on the first intersection information, to obtain an updated well trajectory, and advancing the drilling tool into the subsurface based on the updated well trajectory.

40 Claims, 10 Drawing Sheets

U.S. PATENT DOCUMENTS

| | | | | |
|---|---|---|---|---|
| 6,662,110 | B1 | 12/2003 | Bargach et al. | |
| 6,801,197 | B2 | 10/2004 | Sanstrom | |
| 6,834,732 | B2 * | 12/2004 | Haarstad | 175/45 |
| 6,892,812 | B2 | 5/2005 | Niedermayr et al. | |
| 6,980,940 | B1 | 12/2005 | Gurpinar et al. | |
| 7,003,439 | B2 | 2/2006 | Aldred et al. | |
| 7,054,750 | B2 | 5/2006 | Rodney et al. | |
| 7,079,952 | B2 | 7/2006 | Thomas et al. | |
| 7,128,167 | B2 | 10/2006 | Dunlop et al. | |
| 7,599,797 | B2 * | 10/2009 | Poedjono et al. | 701/301 |
| 2003/0132934 | A1 | 7/2003 | Fremming | |
| 2003/0216897 | A1 | 11/2003 | Endres et al. | |
| 2004/0220846 | A1 | 11/2004 | Cullick et al. | |
| 2005/0149307 | A1 | 7/2005 | Gurpinar et al. | |
| 2005/0209836 | A1 | 9/2005 | Klumpen et al. | |
| 2005/0209886 | A1 | 9/2005 | Corkern | |
| 2005/0211468 | A1 | 9/2005 | Veeningen et al. | |
| 2005/0228905 | A1 | 10/2005 | Veeningen et al. | |
| 2005/0236184 | A1 | 10/2005 | Veeningen et al. | |
| 2006/0197759 | A1 | 9/2006 | Fremming | |
| 2007/0112547 | A1 | 5/2007 | Ghorayeb et al. | |

FOREIGN PATENT DOCUMENTS

| | | |
|---|---|---|
| GB | 2411669 | 9/2005 |
| WO | 9964896 | 12/1999 |
| WO | 2004049216 | 6/2004 |

* cited by examiner

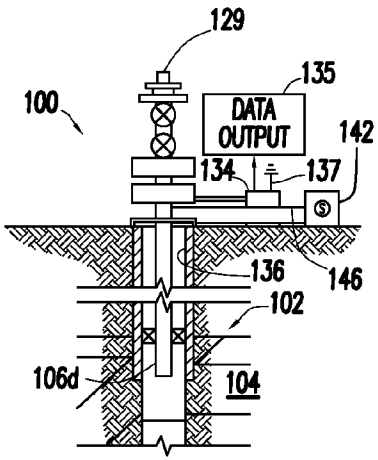
FIG. 1A
FIG. 1B
FIG. 1C
FIG. 1D
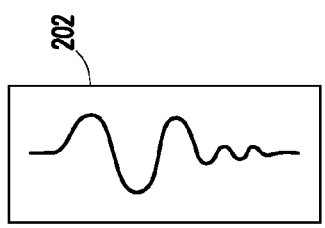
FIG. 2A
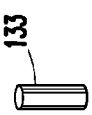
FIG. 2B
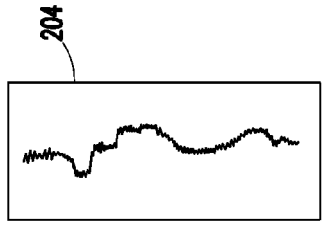
FIG. 2C
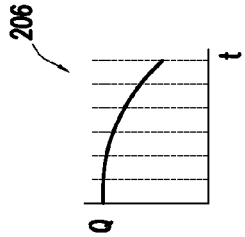
FIG. 2D

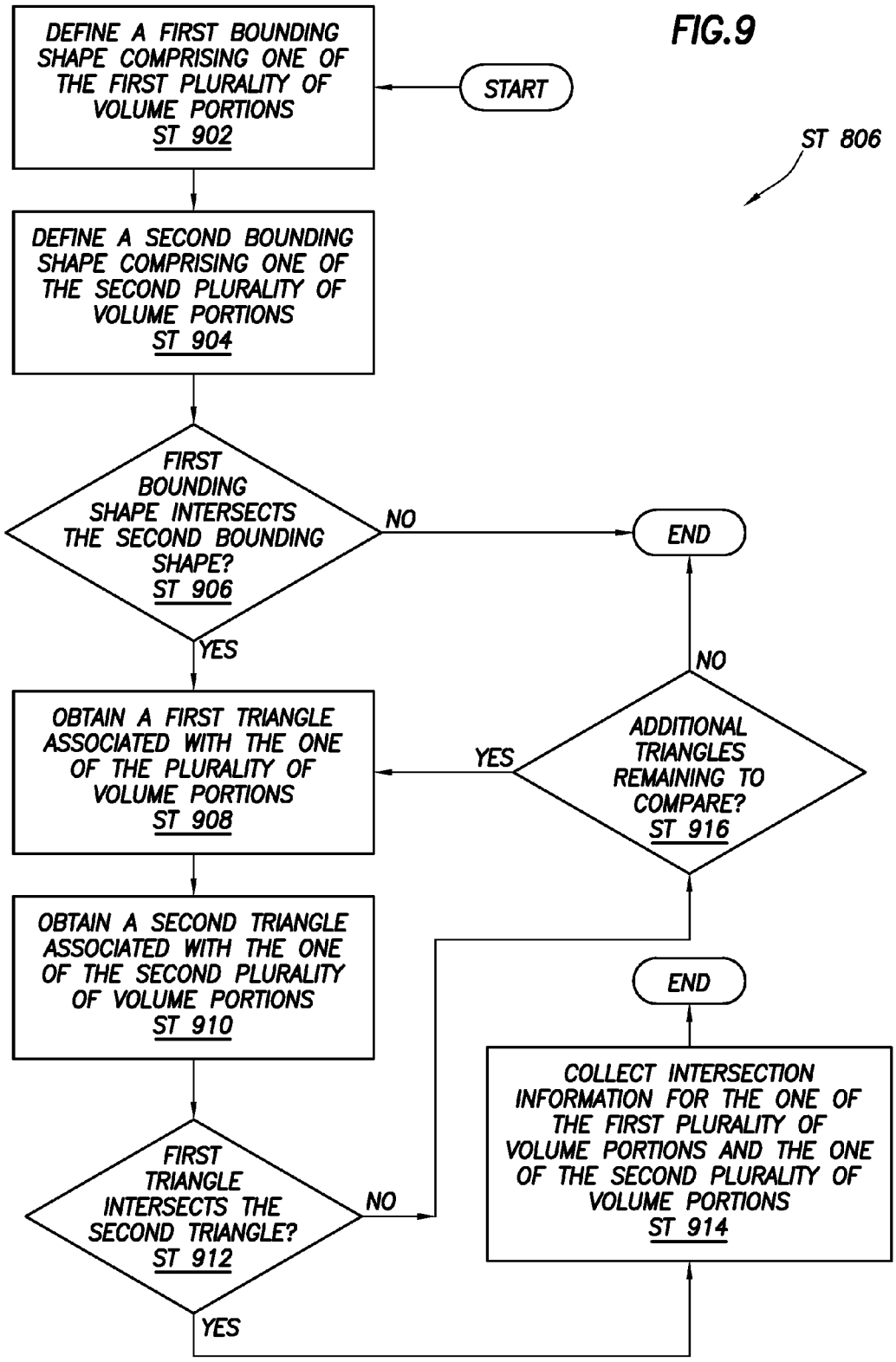
FIG.9
ST 806
START
DEFINE A FIRST BOUNDING SHAPE COMPRISING ONE OF THE FIRST PLURALITY OF VOLUME PORTIONS
ST 902
DEFINE A SECOND BOUNDING SHAPE COMPRISING ONE OF THE SECOND PLURALITY OF VOLUME PORTIONS
ST 904
FIRST BOUNDING SHAPE INTERSECTS THE SECOND BOUNDING SHAPE?
ST 906
NO
END
YES
OBTAIN A FIRST TRIANGLE ASSOCIATED WITH THE ONE OF THE PLURALITY OF VOLUME PORTIONS
ST 908
OBTAIN A SECOND TRIANGLE ASSOCIATED WITH THE ONE OF THE SECOND PLURALITY OF VOLUME PORTIONS
ST 910
FIRST TRIANGLE INTERSECTS THE SECOND TRIANGLE?
ST 912
NO
YES
COLLECT INTERSECTION INFORMATION FOR THE ONE OF THE FIRST PLURALITY OF VOLUME PORTIONS AND THE ONE OF THE SECOND PLURALITY OF VOLUME PORTIONS
ST 914
END
ADDITIONAL TRIANGLES REMAINING TO COMPARE?
ST 916
YES
NO

SYSTEM AND METHOD FOR PERFORMING A DRILLING OPERATION IN AN OILFIELD

CROSS-REFERENCE TO RELATED APPLICATION

This application claims priority, pursuant to 35 U.S.C. §119(e), to U.S. Patent Application Ser. No. 60/931,063, entitled "System and Method for Performing a Drilling Operation in an Oilfield," filed on May 21, 2007, which is herein incorporated by reference in its entirety.

BACKGROUND OF THE INVENTION

1. Field of the Invention

The present invention relates to techniques for performing oilfield operations relating to subterranean formations having reservoirs therein. More particularly, the invention relates to techniques for performing drilling operations involving an analysis of drilling equipment, drilling conditions and other oilfield parameters that impact the drilling operations.

2. Background of the Related Art

Oilfield operations, such as surveying, drilling, wireline testing, completions and production, are typically performed to locate and gather valuable downhole fluids. As shown in FIG. 1A, surveys are often performed using acquisition methodologies, such as seismic scanners to generate maps of underground structures. These structures are often analyzed to determine the presence of subterranean assets, such as valuable fluids or minerals. This information is used to assess the underground structures and locate the formations containing the desired subterranean assets. Data collected from the acquisition methodologies may be evaluated and analyzed to determine whether such valuable items are present, and if they are reasonably accessible.

A formation is a distinctive and continuous body of rock that it can be mapped. Spaces between the rock grains ("porosity") of a formation may contain fluids such as oil, gas or water. Connections between the spaces ("permeability") may allow the fluids to move through the formation. Formations with sufficient porosity and permeability to store fluids and allow the fluids to move are known as reservoirs. A structure is a geological feature that is created by deformation of the Earth's crust, such as a fold or fault, a feature within the rock itself (such as a fracture) or, more generally, an arrangement of rocks. The above definitions are taken from Schlumberger's Oilfield Glossary (www.glossary.oilfield.slb.com), but in the industry, the terms formation and structure may be loosely used synonymously.

As shown in FIGS. 1B-1D, one or more wellsites may be positioned along the underground structures to gather valuable fluids from the subterranean reservoirs. The wellsites are provided with tools capable of locating and removing hydrocarbons from the subterranean reservoirs. As shown in FIG. 1B, drilling tools are typically advanced from the oil rigs and into the earth along a given path to locate the valuable downhole fluids. During the drilling operation, the drilling tool may perform downhole measurements to investigate downhole conditions. In some cases, as shown in FIG. 1C, the drilling tool is removed and a wireline tool is deployed into the wellbore to perform additional downhole testing. Throughout this document, the term "wellbore" is used interchangeably with the term "borehole."

After the drilling operation is complete, the well may then be prepared for production. As shown in FIG. 1D, wellbore completions equipment is deployed into the wellbore to complete the well in preparation for the production of fluid there-through. Fluid is then drawn from downhole reservoirs, into the wellbore and flows to the surface. Production facilities are positioned at surface locations to collect the hydrocarbons from the wellsite(s). Fluid drawn from the subterranean reservoir(s) passes to the production facilities via transport mechanisms, such as tubing. Various equipments may be positioned about the oilfield to monitor oilfield parameters and/or to manipulate the oilfield operations.

During the oilfield operations, data is typically collected for analysis and/or monitoring of the oilfield operations. Such data may include, for example, subterranean formation, equipment, historical and/or other data. Data concerning the subterranean formation is collected using a variety of sources. Such formation data may be static or dynamic. Static data relates to formation structure and geological stratigraphy that defines the geological structure of the subterranean formation. Dynamic data relates to fluids flowing through the geologic structures of the subterranean formation. Such static and/or dynamic data may be collected to learn more about the formations and the valuable assets contained therein.

Sources used to collect static data may be seismic tools, such as a seismic truck that sends compression waves into the earth as shown in FIG. 1A. These waves are measured to characterize changes in the density of the geological structure at different depths. This information may be used to generate basic structural maps of the subterranean formation. Other static measurements may be gathered using core sampling and well logging techniques. Core samples are used to take physical specimens of the formation at various depths as shown in FIG. 1B. Well logging involves deployment of a downhole tool into the wellbore to collect various downhole measurements, such as density, resistivity, etc., at various depths. Such well logging may be performed using, for example, the drilling tool of FIG. 1B and/or the wireline tool of FIG. 1C. Once the well is formed and completed, fluid flows to the surface using production tubing as shown in FIG. 1D. As fluid passes to the surface, various dynamic measurements, such as fluid flow rates, pressure and composition may be monitored. These parameters may be used to determine various characteristics of the subterranean formation.

Sensors may be positioned about the oilfield to collect data relating to various oilfield operations. For example, sensors in the wellbore may monitor fluid composition, sensors located along the flow path may monitor flow rates and sensors at the processing facility may monitor fluids collected. Other sensors may be provided to monitor downhole, surface, equipment or other conditions. The monitored data is often used to make decisions at various locations of the oilfield at various times. Data collected by these sensors may be further analyzed and processed. Data may be collected and used for current or future operations. When used for future operations at the same or other locations, such data may sometimes be referred to as historical data.

The processed data may be used to predict downhole conditions, and make decisions concerning oilfield operations. Such decisions may involve well planning, well targeting, well completions, operating levels, production rates and other configurations. Often this information is used to determine when to drill new wells, re-complete existing wells or alter wellbore production.

Data from one or more wellbores may be analyzed to plan or predict various outcomes at a given wellbore. In some cases, the data from neighboring wellbores, or wellbores with similar conditions or equipment is used to predict how a well will perform. There are usually a large number of variables and large quantities of data to consider in analyzing wellbore operations. It is, therefore, often useful to model the behavior of the oilfield operation to determine the desired course of action. During the ongoing operations, the operating conditions may need adjustment as conditions change and new information is received.

Techniques have been developed to model the behavior of geological structures, downhole reservoirs, wellbores, surface facilities as well as other portions of the oilfield operation. Examples of modeling techniques are shown in patent/application Nos. U.S. Pat. No. 5,992,519, WO2004/049216, WO1999/064896, U.S. Pat. No. 6,313,837, US2003/0216897, US2003/0132934, US2005/0149307, and US2006/0197759. Typically, existing modeling techniques have been used to analyze only specific portions of the oilfield operation. More recently, attempts have been made to use more than one model in analyzing certain oilfield operations. See, for example, U.S. patent application Ser. Nos. U.S. Pat. No. 6,980,940, WO2004/049216, US2004/0220846, and U.S. Ser. No. 10/586,283.

Techniques have also been developed to predict and/or plan certain oilfield operations, such as drilling operations. Examples of techniques for generating drilling plans are provided in US Patent/Application Nos. 20050236184, 20050211468, 20050228905, 20050209886, and 20050209836. Some drilling techniques involve controlling the drilling operation. Examples of such drilling techniques are shown in Patent/Application Nos. GB2392931 and GB2411669. Other drilling techniques seek to provide real-time drilling operations. Examples of techniques purporting to provide real time drilling are described in U.S. Pat. Nos. 7,079,952, 6,266,619, 5,899,958, 5,139,094, 7,003,439 and 5,680,906.

SUMMARY OF THE INVENTION

In general, in one aspect, the invention relates to a method for performing a drilling operation at a wellsite having a drilling rig configured to advance a drilling tool into a subsurface. The method steps include obtaining a well trajectory associated with a first volume, obtaining information related to a first subsurface entity associated with a second volume, using a three-dimensional relational comparison to determine that the first volume intersects the second volume to define a first intersection information, updating the well trajectory, based on the first intersection information, to obtain an updated well trajectory, and advancing the drilling tool into the subsurface based on the updated well trajectory.

In general, in one aspect, the invention relates to a method for performing a drilling operation at a wellsite having a drilling rig configured to advance a drilling tool into a subsurface. The method steps include obtaining a geologic target based on geologic information, where the geologic target is associated with a first volume, specifying a well target based on the geologic target and geologic information associated with the geologic target, where the well target corresponds to a subset of the first volume, obtaining a well trajectory based on the well target, and advancing the drilling tool into the subsurface based on the well trajectory.

In general, in one aspect, the invention relates to a system for performing a drilling operation at a wellsite having a drilling rig configured to advance a drilling tool into a subsurface. The system includes an interface configured to obtain a well trajectory, where the well trajectory is associated with a first volume, and configured to obtain information associated with a first subsurface entity, where the first subsurface entity is associated with a second volume. The system also include a modeling unit configured to determine that the first volume intersects the second volume using a three-dimensional relational comparison to obtain first intersection information and to update the well trajectory, based on the first intersection information, to obtain an updated well trajectory.

In general, in one aspect, the invention relates to a computer program product embodying instructions executable by the computer to perform method steps for performing a drilling operation at a wellsite having a drilling rig configured to advance a drilling tool into a subsurface. The instructions include functionality to obtain a well trajectory associated with a first volume, to obtain information related to a first subsurface entity associated with a second volume, to use a three-dimensional relational comparison to determine that the first volume intersects the second volume to define a first intersection information, to update the well trajectory, based on the first intersection information, to obtain an updated well trajectory, and to advance the drilling tool into the subsurface based on the updated well trajectory.

Other aspects and advantages of the invention will be apparent from the following description and the appended claims.

BRIEF DESCRIPTION OF DRAWINGS

FIGS. 1A-1D depict a schematic view of an oilfield having subterranean structures containing reservoirs therein, various oilfield operations being performed on the oilfield.

FIGS. 2A-2D show graphical depictions of data collected by the tools of FIGS. 1A-1D, respectively.

FIGS. 6-9 show exemplary flow charts depicting methods for performing a drilling operation of an oilfield.

DETAILED DESCRIPTION

Figure 3:
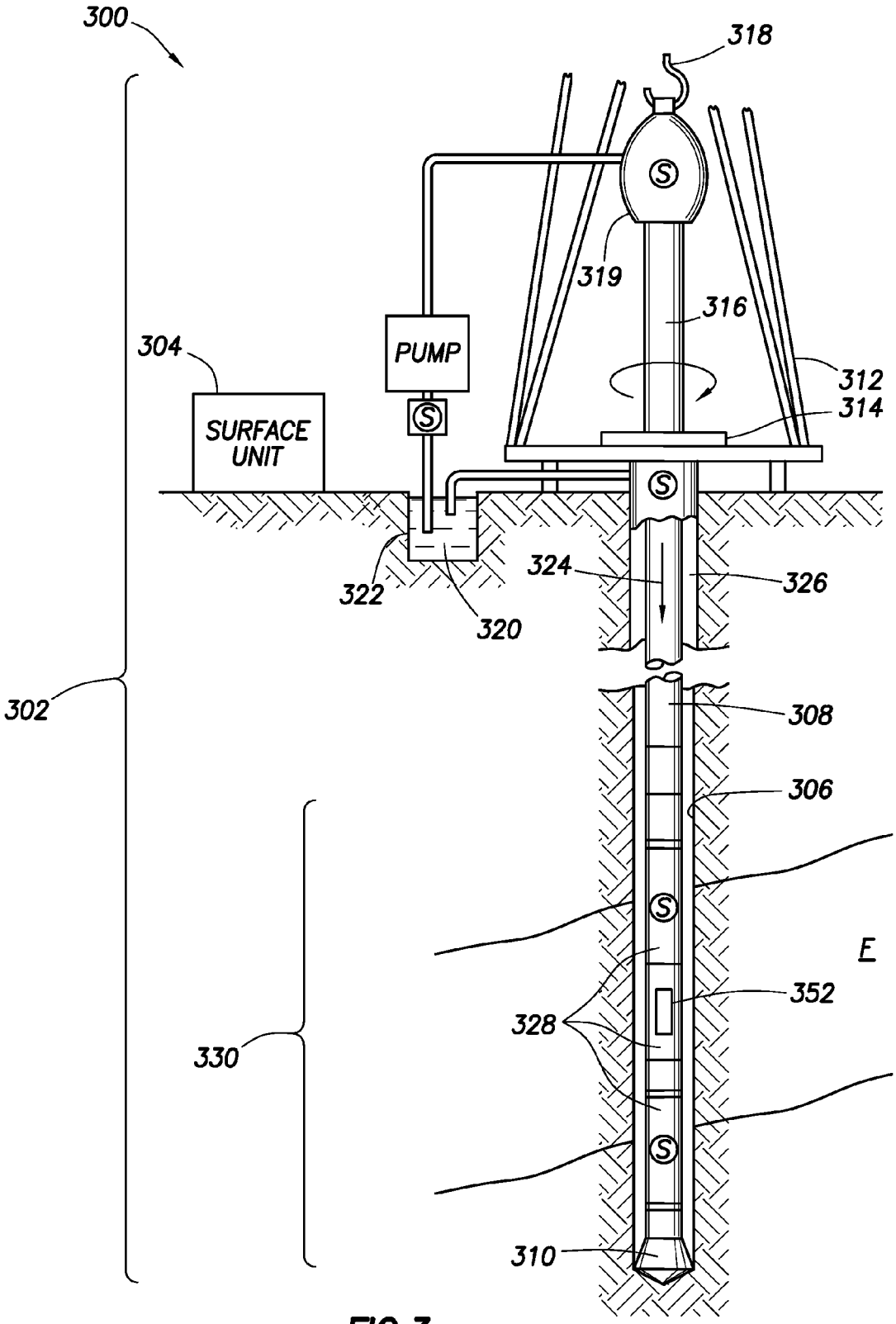
FIG. 3 shows a schematic view, partially in cross-section of a drilling operation of an oilfield.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. In other instances, well-known features have not been described in detail to avoid obscuring the invention. The use of "ST" and "Step" as used herein and in the Figures are essentially the same for the purposes of this patent application.

The present invention involves applications generated for the oil and gas industry. FIGS. 1A-1D illustrate an exemplary oilfield (100) with subterranean structures and geological structures therein. More specifically, FIGS. 1A-1D depict schematic views of an oilfield (100) having subterranean structures (102) containing a reservoir (104) therein and depicting various oilfield operations being performed on the oilfield. Various measurements of the subterranean formation are taken by different tools at the same location. These measurements may be used to generate information about the formation and/or the geological structures and/or fluids contained therein.

FIG. 1A depicts a survey operation being performed by a seismic truck (106*a*) to measure properties of the subterranean formation. The survey operation is a seismic survey operation for producing sound vibrations. In FIG. 1A, an acoustic source (110) produces sound vibrations (112) that reflect off a plurality of horizons (114) in an earth formation (116). The sound vibration(s) (112) is (are) received in by sensors, such as geophone-receivers (118), situated on the earth's surface, and the geophones-receivers (118) produce electrical output signals, referred to as data received (120) in FIG. 1A.

The received sound vibration(s) (112) are representative of different parameters (such as amplitude and/or frequency). The data received (120) is provided as input data to a computer (122*a*) of the seismic truck (106*a*), and responsive to the input data, the recording truck computer (122*a*) generates a seismic data output record (124). The seismic data may be further processed, as desired, for example by data reduction.

FIG. 1B depicts a drilling operation being performed by a drilling tool (106*b*) suspended by a rig (128) and advanced into the subterranean formation (102) to form a wellbore (136). A mud pit (130) is used to draw drilling mud into the drilling tool via a flow line (132) for circulating drilling mud through the drilling tool and back to the surface. The drilling tool is advanced into the formation to reach the reservoir (104). The drilling tool is preferably adapted for measuring downhole properties. The logging while drilling tool may also be adapted for taking a core sample (133) as shown, or removed so that a core sample (133) may be taken using another tool.

A surface unit (134) is used to communicate with the drilling tool and offsite operations. The surface unit (134) is capable of communicating with the drilling tool (106*b*) to send commands to drive the drilling tool (106*b*), and to receive data therefrom. The surface unit (134) is preferably provided with computer facilities for receiving, storing, processing, and analyzing data from the oilfield. The surface unit (134) collects data output (135) generated during the drilling operation. Such data output (135) may be stored on a computer readable medium (compact disc (CD), tape drive, hard disk, flash memory, or other suitable storage medium). Further, data output (135) may be stored on a computer program product that is stored, copied, and/or distributed, as necessary. Computer facilities, such as those of the surface unit, may be positioned at various locations about the oilfield and/or at remote locations.

Sensors (S), such as gauges, may be positioned throughout the reservoir, rig, oilfield equipment (such as the downhole tool), or other portions of the oilfield for gathering information about various parameters, such as surface parameters, downhole parameters, and/or operating conditions. These sensors (S) preferably measure oilfield parameters, such as weight on bit, torque on bit, pressures, temperatures, flow rates, compositions, measured depth, azimuth, inclination and other parameters of the oilfield operation.

The information gathered by the sensors (S) may be collected by the surface unit (134) and/or other data collection sources for analysis or other processing. The data collected by the sensors (S) may be used alone or in combination with other data. The data may be collected in a database and all or select portions of the data may be selectively used for analyzing and/or predicting oilfield operations of the current and/or other wellbores.

Data outputs from the various sensors (S) positioned about the oilfield may be processed for use. The data may be may be historical data, real time data, or combinations thereof. The real time data may be used in real time, or stored for later use. The data may also be combined with historical data or other inputs for further analysis. The data may be housed in separate databases, or combined into a single database.

The collected data may be used to perform analysis, such as modeling operations. For example, the seismic data output may be used to perform geological, geophysical, and/or reservoir engineering simulations. The reservoir, wellbore, surface, and/or process data may be used to perform reservoir, wellbore, or other production simulations. The data outputs (135) from the oilfield operation may be generated directly from the sensors (S), or after some preprocessing or modeling. These data outputs (135) may act as inputs for further analysis.

The data is collected and stored at the surface unit (134). One or more surface units may be located at the oilfield, or linked remotely thereto. The surface unit (134) may be a single unit, or a complex network of units used to perform the necessary data management functions throughout the oilfield. The surface unit (134) may be a manual or automatic system. The surface unit (134) may be operated and/or adjusted by a user.

The surface unit (134) may be provided with a transceiver (137) to allow communications between the surface unit (134) and various portions of the oilfield and/or other locations. The surface unit (134) may also be provided with or functionally linked to a controller for actuating mechanisms at the oilfield. The surface unit (134) may then send command signals to the oilfield in response to data received. The surface unit (134) may receive commands via the transceiver (137) or may itself execute commands to the controller. A processor may be provided to analyze the data (locally or remotely) and make the decisions to actuate the controller. In this manner, the oilfield may be selectively adjusted based on the data collected. These adjustments may be made automatically based on computer protocol, or manually by an operator. In some cases, well plans and/or well placement may be adjusted to select optimum operating conditions, or to avoid problems.

FIG. 1C depicts a wireline operation being performed by a wireline tool (106*c*) suspended by the rig (128) and into the wellbore (136) of FIG. 1B. The wireline tool (106*c*) is preferably adapted for deployment into a wellbore (136) for performing well logs, performing downhole tests and/or collecting samples. The wireline tool (106*c*) may be used to provide another method and apparatus for performing a seismic survey operation. The wireline tool (106*c*) of FIG. 1C may have an explosive or acoustic energy source (144) that provides electrical signals to the surrounding subterranean formations (102).

The wireline tool (106*c*) may be operatively linked to, for example, the geophone-receivers (118) stored in the computer (122*a*) of the seismic recording truck (106*a*) of FIG. 1A. The wireline tool (106*c*) may also provide data to the surface unit (134). As shown data output (135) is generated by the wireline tool (106*c*) and collected at the surface. The wireline tool (106*c*) may be positioned at various depths in the wellbore (136) to provide a survey of the subterranean formation (102).

FIG. 1D depicts a production operation being performed by a production tool (106*d*) deployed from a production unit or christmas tree (129) and into the completed wellbore (136) of FIG. 1C for drawing fluid from the downhole reservoirs into the surface facilities (142). Fluid flows from reservoir (104) through perforations in the casing (not shown) and into the production tool (106*d*) in the wellbore (136) and to the surface facilities (142) via a gathering network (146).

Sensors (S), such as gauges, may be positioned about the oilfield to collect data relating to various oilfield operations as described previously. As shown, the sensor (S) may be positioned in the production tool (106*d*) or associated equipment, such as the christmas tree, gathering network, surface facilities and/or the production facility, to measure fluid parameters, such as fluid composition, flow rates, pressures, temperatures, and/or other parameters of the production operation.

While only simplified wellsite configurations are shown, it will be appreciated that the oilfield may cover a portion of land, sea and/or water locations that hosts one or more wellsites. Production may also include injection wells (not shown) for added recovery. One or more gathering facilities may be operatively connected to one or more of the wellsites for selectively collecting downhole fluids from the wellsite (s).

During the production process, data output (135) may be collected from various sensors (S) and passed to the surface unit (134) and/or processing facilities. This data may be, for example, reservoir data, wellbore data, surface data, and/or process data.

Throughout the oilfield operations depicted in FIGS. 1A-1D, there are numerous business considerations. For example, the equipment used in each of these Figures has various costs and/or risks associated therewith. At least some of the data collected at the oilfield relates to business considerations, such as value and risk. This business data may include, for example, production costs, rig time, storage fees, price of oil/gas, weather considerations, political stability, tax rates, equipment availability, geological environment, and other factors that affect the cost of performing the oilfield operations or potential liabilities relating thereto. Decisions may be made and strategic business plans developed to alleviate potential costs and risks. For example, an oilfield plan may be based on these business considerations. Such an oilfield plan may, for example, determine the location of the rig, as well as the depth, number of wells, duration of operation and other factors that will affect the costs and risks associated with the oilfield operation.

While FIGS. 1A-1D depicts monitoring tools used to measure properties of an oilfield, it will be appreciated that the tools may be used in connection with non-oilfield operations, such as mines, aquifers or other subterranean facilities. In addition, while certain data acquisition tools are depicted, it will be appreciated that various measurement tools capable of sensing properties, such as seismic two-way travel time, density, resistivity, production rate, etc., of the subterranean formation and/or its geological structures may be used. Various sensors (S) may be located at various positions along the subterranean formation and/or the monitoring tools to collect and/or monitor the desired data. Other sources of data may also be provided from offsite locations.

The oilfield configuration of FIGS. 1A-1D is not intended to limit the scope of the invention. Part, or all, of the oilfield may be on land and/or sea. In addition, while a single oilfield measured at a single location is depicted, the present invention may be utilized with any combination of one or more oilfields, one or more processing facilities, and one or more wellsites.

FIGS. 2A-2D are graphical depictions of data collected by the tools of FIGS. 1A-1D, respectively. FIG. 2A depicts a seismic trace (202) of the subterranean formation of FIG. 1A taken by survey tool (106*a*). The seismic trace measures the two-way response over a period of time. FIG. 2B depicts a core sample (133) taken by the logging tool (106*b*). The core test typically provides a graph of the density, resistivity, or other physical property of the core sample over the length of the core. FIG. 2C depicts a well log (204) of the subterranean formation of FIG. 1C taken by the wireline tool (106*c*). The wireline log typically provides a resistivity measurement of the formation at various depts. FIG. 2D depicts a production decline curve (206) of fluid flowing through the subterranean formation of FIG. 1D taken by the production tool (106*d*). The production decline curve typically provides the production rate (Q) as a function of time (t).

The respective graphs of FIGS. 2A-2C contain static measurements that describe the physical characteristics of the formation. These measurements may be compared to determine the accuracy of the measurements and/or for checking for errors. In this manner, the plots of each of the respective measurements may be aligned and scaled for comparison and verification of the properties.

FIG. 2D provides a dynamic measurement of the fluid properties through the wellbore. As the fluid flows through the wellbore, measurements are taken of fluid properties, such as flow rates, pressures, composition, etc. As described below, the static and dynamic measurements may be used to generate models of the subterranean formation to determine characteristics thereof.

The models may be used to create an earth model defining the subsurface conditions. This earth model predicts the structure and its behavior as oilfield operations occur. As new information is gathered, part or all of the earth model may need adjustment.

FIG. 3 is a schematic view of a wellsite (300) depicting a drilling operation, such as the drilling operation of FIG. 1B, of an oilfield in detail. The wellsite system (300) includes a drilling system (302) and a surface unit (304). In the illustrated embodiment, a borehole (306) is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling), and is not limited to land-based rigs.

The drilling system (302) includes a drill string (308) suspended within the borehole (306) with a drill bit (310) at its lower end. The drilling system (302) also includes the land-based platform and derrick assembly (312) positioned over the borehole (306) penetrating a subsurface formation (F). The assembly (312) includes a rotary table (314), kelly (316), hook (318), and rotary swivel (319). The drill string (308) is rotated by the rotary table (314), energized by means not shown, which engages the kelly (316) at the upper end of the drill string. The drill string (308) is suspended from hook (318), attached to a traveling block (also not shown), through the kelly (316) and a rotary swivel (319) which permits rotation of the drill string relative to the hook.

The drilling system (302) farther includes drilling fluid or mud (320) stored in a pit (322) formed at the well site. A pump delivers the drilling fluid (320) to the interior of the drill string (308) via a port in the swivel (319), inducing the drilling fluid to flow downwardly through the drill string (308) as indicated by the directional arrow (324). The drilling fluid exits the drill string (308) via ports in the drill bit (310), and then circulates upwardly through the region between the outside of the drill string and the wall of the borehole, called the annulus (326). In this manner, the drilling fluid lubricates the drill bit (310) and carries formation cuttings up to the surface as it is returned to the pit (322) for recirculation.

The drill string (308) further includes a bottom hole assembly (BHA), generally referred to as (330), near the drill bit (310) (in other words, within several drill collar lengths from the drill bit). The bottom hole assembly (330) includes capabilities for measuring, processing, and storing information, as well as communicating with the surface unit. The BHA (330) further includes drill collars (328) for performing various other measurement functions.

Sensors (S) are located about the wellsite to collect data, preferably in real time, concerning the operation of the wellsite, as well as conditions at the wellsite. The sensors (S) of FIG. 3 may be the same as the sensors of FIGS. 1A-1D. The sensors of FIG. 3 may also have features or capabilities, of monitors, such as cameras (not shown), to provide pictures of the operation. Surface sensors or gauges (S) may be deployed about the surface systems to provide information about the surface unit, such as standpipe pressure, hookload, depth, surface torque, rotary rpm, among others. Downhole sensors or gauges (S) are disposed about the drilling tool and/or wellbore to provide information about downhole conditions, such as wellbore pressure, weight on bit, torque on bit, direction, inclination, collar rpm, tool temperature, annular temperature and toolface, among others. The information collected by the sensors and cameras is conveyed to the various parts of the drilling system and/or the surface control unit.

The drilling system (302) is operatively connected to the surface unit (304) for communication therewith. The BHA (330) is provided with a communication subassembly (352) that communicates with the surface unit. The communication subassembly (352) is adapted to send signals to and receive signals from the surface using mud pulse telemetry. The communication subassembly may include, for example, a transmitter that generates a signal, such as an acoustic or electromagnetic signal, which is representative of the measured drilling parameters. Communication between the downhole and surface systems is depicted as being mud pulse telemetry, such as the one described in U.S. Pat. No. 5,517,464, assigned to the assignee of the present invention. It will be appreciated by one of skill in the art that a variety of telemetry systems may be employed, such as wired drill pipe, electromagnetic or other known telemetry systems.

Typically, the borehole (306) is drilled according to a drilling plan that is established prior to drilling. The drilling plan typically sets forth equipment, pressures, trajectories and/or other parameters that define the drilling process for the wellsite (300). The drilling operation may then be performed according to the drilling plan, However, as information is gathered, the drilling operation may need to deviate from the drilling plan. Additionally, as drilling or other operations are performed, the subsurface conditions may change. The earth model may also need adjustment as new information is collected.

Figure 4:
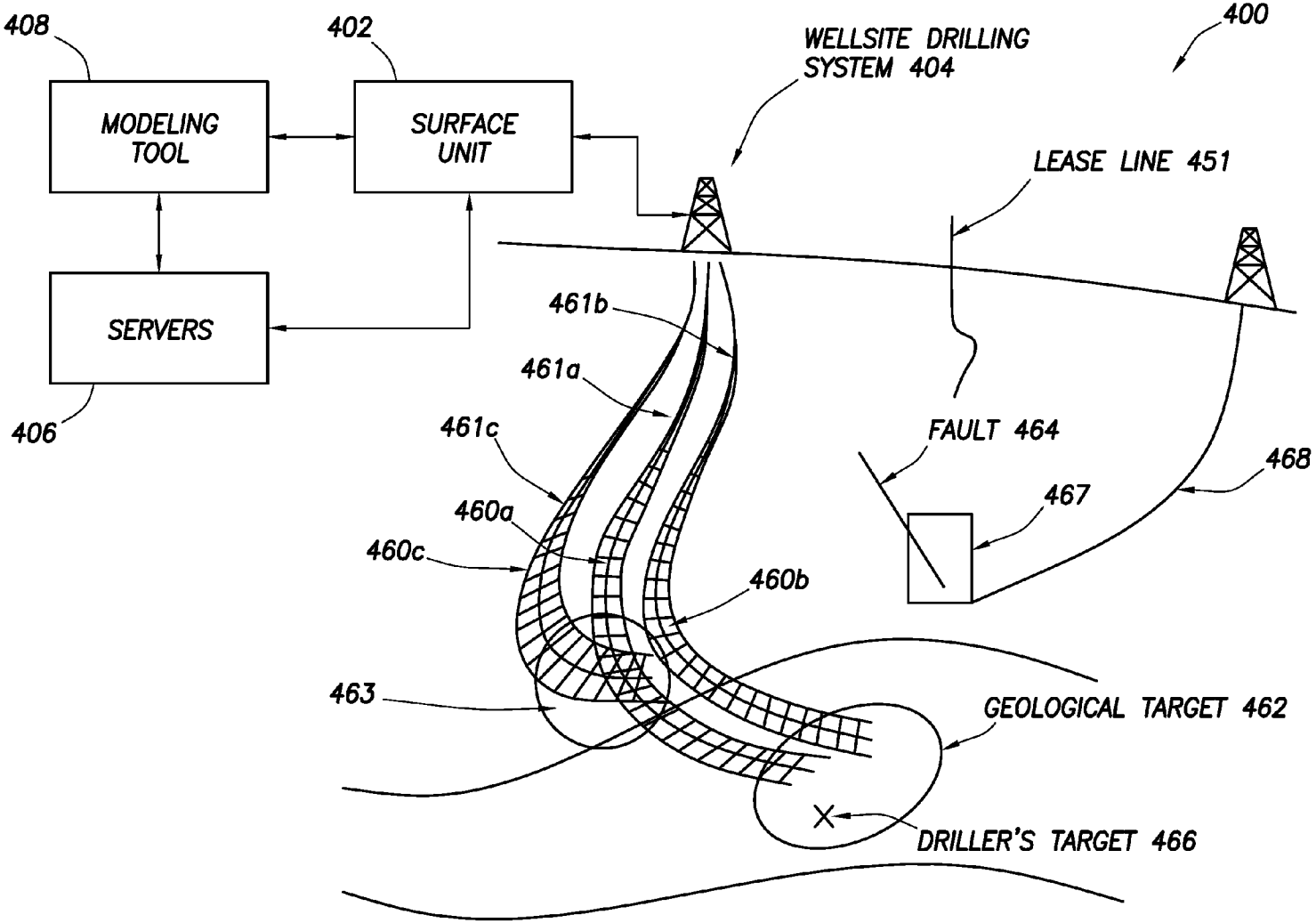
FIGS. 4-5 show exemplary schematic diagrams of systems for performing a drilling operation of an oilfield.

FIG. 4 is a schematic view of a system (400) for performing a drilling operation in an oilfield. As shown, the system (400) includes a surface unit (402) operatively connected to a wellsite drilling system (404), servers (406) operatively linked to the surface unit (402), and a modeling tool (408) operatively linked to the servers (406). As shown, the wellsite drilling system (404) is configured to advance a drilling tool into a subsurface.

The subsurface may comprise subsurface entities. A subsurface entity may correspond to a physical structure, a boundary, a trajectory, or some other volume in the subsurface. Examples of a subsurface entity include, but are not limited to, a lease boundary (451), a planned well trajectory (e.g., 461*c*), a sidetrack well trajectory (not shown), an existing well trajectory (e.g., 461*a*, 461*b*), a geologic formation (462), a geologic boundary, a political boundary (e.g., a border), and some other subsurface entity capable of being defined in an earth model. A sidetrack well trajectory (not shown) may describe a sidetrack well that originates along an original well trajectory and diverges from the original well trajectory. In other words, the original well trajectory is intended to intersect the sidetrack well trajectory (not shown). In contrast, a planned well trajectory (e.g., 461*c*) is not intended to intersect existing well trajectories (e.g., 461*a*, 461*b*) and other subsurface entities. In this case, a collision (463) may identified at the location the planned well trajectory (e.g., 461*c*) and the existing well trajectory (e.g., 461*a*) intersect.

In one or more embodiments of the invention, the subsurface entities may be defined based on geologic data (actual, historical, or a combination thereof), lease boundaries, political boundaries, and/or some other data capable of defining a volume in the subsurface. The geologic data may be data measured by the sensors (S) of the wellsite as described with respect to FIGS. 1A-1D and 3. The geologic data may also be data received from other sources (e.g., historical data obtained from an adjacent well).

Information associated with a subsurface entity may also define a volume of the subsurface. In this case, an earth model may define both subsurface entities and information associated with subsurface entities. Examples of information associated with a subsurface entity include, but is not limited to, uncertainty, a separation factor, a target area, or some other information associated with a subsurface entity capable of being defined in an earth model.

More specific examples of information associated with a subsurface entity include: a planned well trajectory (e.g., 461*c*) may be associated with a volume of uncertainty (e.g., 460*c*); an existing well trajectory (historical well trajectory) (e.g., 461*a*, 461*b*) may be associated with a volume of uncertainty (e.g., 460*a*, 460*b*) based on accuracy of tools used in the drilling rig accuracy of geologic data, or other factors that may affect the trajectory of the well; a geologic formation may be associated with a separation factor volume describing a volume encompassing the geologic formation that should be avoided during drilling operations; and a geologic formation may be associated with a geologic target (462) specifying the geologic formation as a target for a drilling operation. In the case of a geologic target (462), a well target (466) may further be specified within the geologic target (462), where the well target (466) describes the optimal portion of the geologic target (462) for the drilling operation.

The volume of uncertainty (460*a*, 460*b*, 460*c*) may correspond to a potential volume in which the actual well may be located. Specifically, the volume of uncertainty (460*a*, 460*b*, 460*c*) may correspond to a bounding cone of uncertainty defined using a group of ellipsoids of uncertainty. Further, each ellipsoid of uncertainty may describe the uncertainty at a point along a well trajectory (461*a*, 461*b*, 461*c*). Alternatively, the volume of uncertainty may be based on some other information (e.g., separation factor, preferred extent, maximum extent, or some other information associated with a subsurface entity). For example, in the case of a fault (464), the separation factor (467) may correspond to a minimum allowable distance between the fault (464) and a planned well trajectory (e.g., 468).

Figure 5:
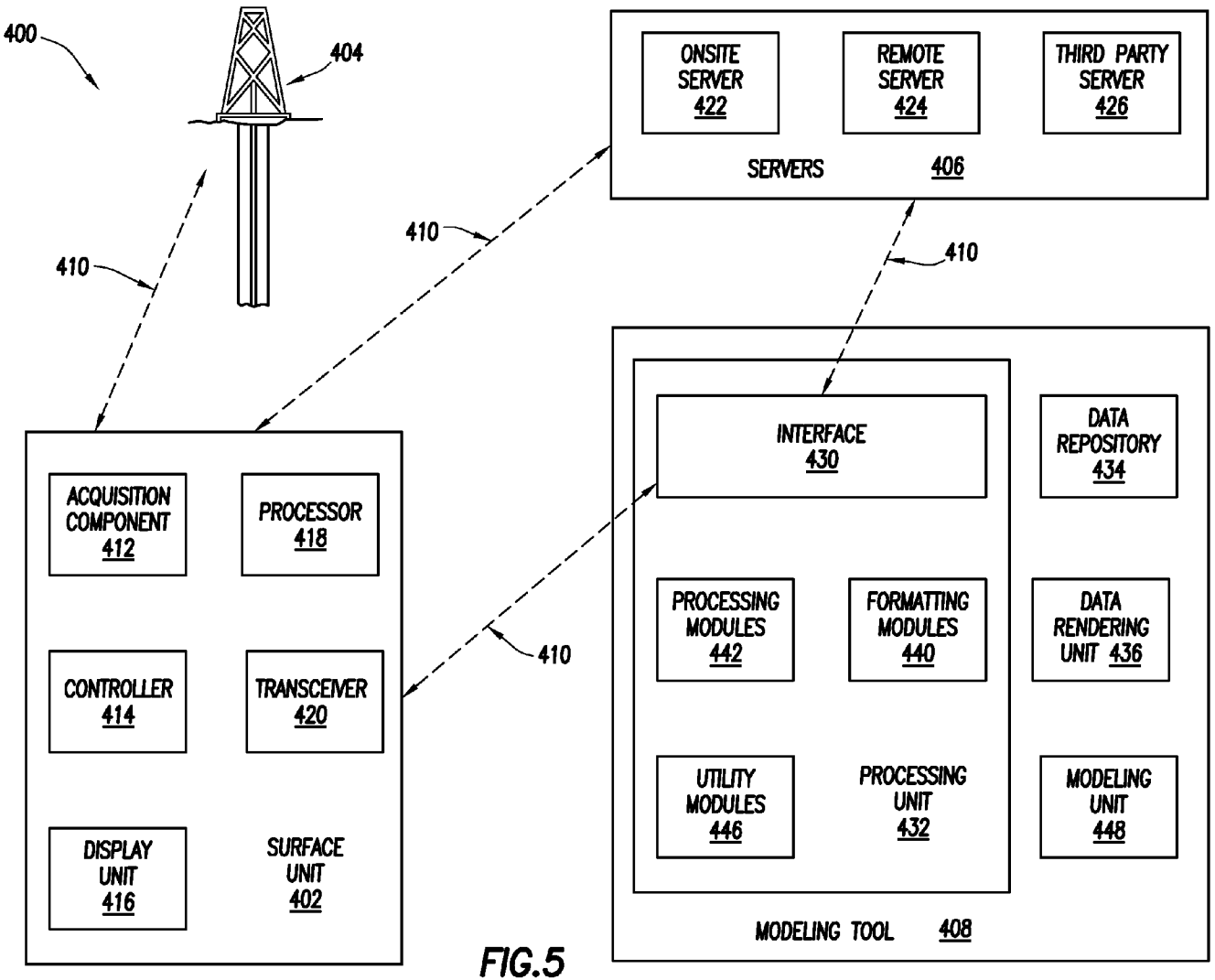

FIG. 5 is a detailed schematic view of the system (400) of FIG. 4 for performing a drilling operation of an oilfield. Similar to what is shown in FIG. 4, the system (400) includes a surface unit (402) operatively connected to a wellsite drilling system (404), servers (406) operatively linked to the surface unit (402), and a modeling tool (408) operatively linked to the servers (406). As shown, communication links (410) are provided between the wellsite drilling system (404), surface unit (402), servers (406), and modeling tool (408). A variety of links may be provided to facilitate the flow of data through the system. For example, the communication links (410) may provide for continuous, intermittent, one-way, two-way and/or selective communication throughout the system (400). The communication links (410) may be of any type, such as wired, wireless, etc.

The wellsite drilling system (404) and surface unit (402) may be the same as the wellsite drilling system and surface unit of FIG. 3. The surface unit (402) is preferably provided with an acquisition component (412), a controller (414), a display unit (416), a processor (418) and a transceiver (420). The acquisition component (412) collects and/or stores data of the oilfield. This data may be data measured by the sensors (S) of the wellsite as described with respect to FIG. 3. This data may also be data received from other sources. The data may also be stored on a computer readable medium such as a compact disk, DVD, optical media, volatile storage, non-volatile storage, or any other medium configured to store the data.

The controller (414) is enabled to enact commands at the oilfield. The controller (414) may be provided with an actuation mechanism that can perform drilling operations, such as steering, advancing, or otherwise taking action at the wellsite. Commands may be generated based on logic of the processor (418), or by commands received from other sources. The processor (418) is preferably provided with features for manipulating and analyzing the data. The processor (418) may be provided with additional functionality to perform oilfield operations.

A display unit (416) may be provided at the wellsite and/or remote locations for viewing oilfield data (not shown). The oilfield data represented by a display unit (416) may be raw data, processed data and/or data outputs generated from various data. The display unit (416) is preferably adapted to provide flexible views of the data, so that the screens depicted may be customized as desired. A user may determine the desired course of action during drilling based on reviewing the displayed oilfield data. The drilling operation may be selectively adjusted in response to the display unit (416). The display unit (416) may include a two dimensional display for viewing oilfield data or defining oilfield events. For example, the two dimensional display may correspond to an output from a printer, plot, a monitor, or another device configured to render two dimensional output. The display unit (416) may also include a three-dimensional display for viewing various aspects of the drilling operation. At least some aspect of the drilling operation is preferably viewed in real time in the three-dimensional display. For example, the three dimensional display may correspond to an output from a printer, plot, a monitor, or another device configured to render three dimensional output.

The transceiver (420) is configured to for provide data access to and/or from other sources. The transceiver (420) is also configured to enable communication with other components, such as the servers (406), the wellsite drilling system (404), surface unit (402) and/or the modeling tool (408).

The servers (406) may be used to transfer data from one or more wellsites to the modeling tool (408). As shown, the server (406) includes onsite servers (422), a remote server (424) and a third-party server (426). The onsite servers (422) may be positioned at the wellsite and/or other adjacent locations for distributing data from the surface unit (402). The remote server (424) is positioned at a location away from the oilfield and provides data from remote sources. The third-party server (426) may be onsite or remote, but is operated by a third-party, such as a client.

The servers (406) are preferably capable of transferring drilling data (e.g., logs), drilling events, trajectory, and/or other oilfield data (e.g., seismic data, historical data, economics data, or other data that may be of use during analysis). The type of server is not intended to limit the invention. Preferably the system is adapted to function with any type of server that may be employed.

The servers (406) communicate with the modeling tool (408) as indicated by the communication links (410). As indicated by the multiple arrows, the servers (406) may have separate communication links (410) with the modeling tool (408). One or more of the servers (406) may be combined or linked to provide a combined communication link (410).

The servers (406) collect a wide variety of data. The data may be collected from a variety of channels that provide a certain type of data, such as well logs. The data from the servers (406) is passed to the modeling tool (408) for processing. The servers (406) may also be used to store and/or transfer data.

The modeling tool (408) is operatively linked to the surface unit (402) for receiving data therefrom. In some cases, the modeling tool (408) and/or server(s) (406) may be positioned at the wellsite. The modeling tool (408) and/or server(s) (406) may also be positioned at various locations. The modeling tool (408) may be operatively linked to the surface unit via the server(s) (406). The modeling tool (408) may also be included in or located near the surface unit (402).

The modeling tool (408) includes an interface (430), a processing unit (432), a modeling unit (448), a data repository (434) and a data rendering unit (436). The interface (430) communicates with other components, such as the servers (406). The interface (430) may also permit communication with other oilfield or non-oilfield sources. The interface (430) receives the data and maps the data for processing. Data from servers (406) typically streams along predefined channels which may be selected by the interface (430).

As depicted in FIG. 5, the interface (430) selects the data channel of the server(s) (406) and receives the data. The interface (430) also maps the data channels to data from the wellsite. The interface (430) may also receive data from a data file (i.e., an extensible markup language (XML) file, a dBase file, or some other data file format). The data may then be passed to the processing modules (442) of the modeling tool (408). The data may be immediately incorporated into the modeling tool (408) for real-time sessions or modeling. The interface (430) creates data requests (for example surveys, logs and risks), displays the user interface, and handles connection state events. The interface (430) also instantiates the data into a data object for processing. The interface (430) may receive a request from at the surface unit (402) to retrieve data from the servers (406), the well unit, and/or data files.

The processing unit (432) includes formatting modules (440), processing modules (442), and utility modules (446). These modules are designed to manipulate the oilfield data for real-time analysis.

The formatting modules (440) are used to conform the data to a desired format for processing. Incoming data may need to be formatted, translated, converted or otherwise manipulated for use. The formatting modules (440) are configured to enable the data from a variety of sources to be formatted and used so that the data processes and displays in real time.

The utility modules (446) provide support functions to the drilling system. The utility modules (446) include the logging component (not shown) and the user interface (UI) manager component (not shown). The logging component provides a common call for all logging data. The logging component allows the logging destination to be set by the application.

The logging component may also be provided with other features, such as a debugger, a messenger, and a warning system, among others. The debugger sends a debug message to those using the system. The messenger sends information to subsystems, users, and others. The information may or may not interrupt the operation and may be distributed to various locations and/or users throughout the system. The warning system may be used to send error messages and warnings to various locations and/or users throughout the system. In some cases, the warning messages may interrupt the process and display alerts.

The UI manager component creates user interface elements for displays. The UI manager component defines user input screens, such as menu items, context menus, toolbars, and settings windows. The user manager component may also be used to handle events relating to these user input screens.

The processing module (442) is used to analyze the data and generate outputs. As described above, the data may include static data, dynamic data, historic data, real-time data, or other types of data. Further, the data may relate to various aspects of the oilfield operations, such as formation structure, geological stratigraphy, core sampling, well logging, density, resistivity, fluid composition, flow rate, downhole condition, surface condition, equipment condition, or other aspects of the oilfield operations.

The processing modules (442) may be used to analyze these data for generating an earth model and making decisions at various locations of the oilfield at various times. For example, an oilfield event, such as drilling event, risk, lesson learned, best practice, or other types of oilfield events may be defined from analyzing these data. Examples of drilling event include stuck pipe, loss of circulation, shocks observed, or other types of drilling events encountered in real time during drilling at various depths and lasting for various durations. Examples of risk includes potential directional control issue from formation dips, potential shallow water flow issue, or other types of potential risk issues. For example, the risk issues may be predicted from analyzing the earth model based on historic data compiled prior to drilling or real-time data acquired during drilling. Lessons learned and best practice may be developed from neighboring wellbores with similar conditions or equipments and defined as oilfield events for reference in determining the desired course of action during drilling.

The data repository (434) may store the data for the modeling unit. The data may be stored in a format available for use in real-time (e.g., information is updated at approximately the same rate the information is received). The data is generally passed to the data repository from the processing component. The data may be persisted in the file system (e.g., as an extensible markup language (XML) file) or in a database. The system (400) may determine which storage is the most appropriate to use for a given piece of data and stores the data in a manner to enable automatic flow of the data through the rest of the system in a seamless and integrated fashion. The system (400) may also facilitates manual and automated workflows (such as Modeling, Geological & Geophysical workflows) based upon the persisted data.

The data rendering unit (436) performs rendering algorithm calculation to provide one or more displays for visualizing the data. The displays may be presented to a user at the display unit (416). The data rendering unit (436) may include a two-dimensional canvas, a three-dimensional canvas, a well section canvas or other canvases as desired.

The data rendering unit (436) may selectively provide displays composed of any combination of one or more canvases. The canvases may or may not be synchronized with each other during display. The data rendering unit (436) may be provided with mechanisms for actuating various canvases or other functions in the system. Further, the data rendering unit (436) may be configured to provide displays representing the oilfield events generated from the real-time drilling data acquired in real-time during drilling, the oilfield events generated from historic data of neighboring wellbores compiled over time, the current trajectory of the wellbore during drilling, the earth model generated from static data of subterranean geological features, and/or any combinations thereof. In addition, the data rendering unit (436) may be configured to selectively adjust the displays based on real-time drilling data such as the drilling tool of the drilling system (404) advances into a subterranean formation.

The modeling unit (448) performs modeling functions for generating complex oilfield outputs. The modeling unit (448) may be a conventional modeling tool capable of performing modeling functions, such as generating, analyzing and manipulating earth models. The earth models typically include exploration and production data, such as that shown in FIGS. 2A-2D. The modeling unit (448) may be used to perform relational comparisons of subsurface entities. The modeling unit (448) may also be used to update an earth model based on relational comparisons of the subsurface entities. Alternatively, the modeling unit (448) may be used to update an earth model based on input from a user.

While specific components are depicted and/or described for use in the units and/or modules of the modeling tool (408), it will be appreciated that a variety of components with various functions may be used to provide the formatting, processing, utility and coordination functions necessary to provide real-time processing in the modeling tool (408). The components may have combined functionalities and may be implemented as software, hardware, firmware, or combinations thereof.

Further, components (e.g., the processing modules (442) and the data rendering unit (436)) of the modeling tool (408) may be located in an onsite server (422) or in distributed locations where remote server (424) and/or third-party server (426) may be involved. The onsite server (422) may be located within the surface unit (402).

Figure 6:
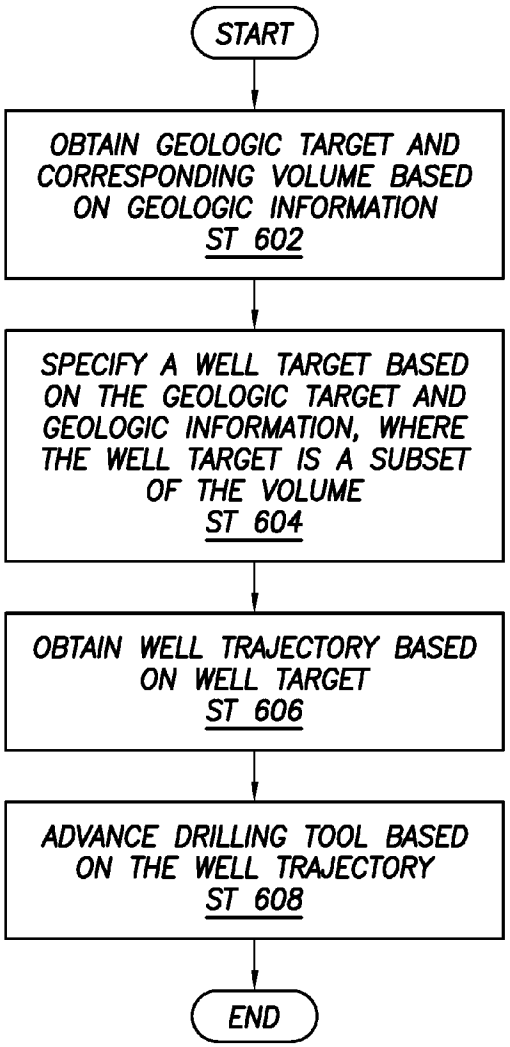

FIG. 6 shows a flow chart depicting a method for performing a drilling operation of an oilfield. The method may be performed using, for example, the system of FIG. 5. The method may involve obtaining a geologic target and a corresponding volume based on geologic information (ST 602), specifying a well target based on the geologic target, where the well target is a subset of the volume associated with the geologic target (ST 604), obtaining a well trajectory based on the well target (ST 606), and advancing a drilling tool based on the well trajectory (ST 608).

The geologic target may be obtained (ST 602) from a variety of sources, As discussed with respect to FIGS. 3 and 5, geologic information may be generated by sensors (S) at the wellsite or from other sources. The geologic information may be transferred directly to the modeling tool (408 in FIG. 5), or transferred to the modeling tool via at least one of the servers (406 in FIG. 5). The geologic information is then generally received by the interface of the modeling tool. The geologic information may be defined as a volume by the processing modules (442 in FIG. 5). The volume and geologic information may then be presented as output. Specifically, the output may be provided by the data rendering unit (436 in FIG. 5) in the modeling tool and presented to a user at the display unit (416 in FIG. 5) in the surface unit (402). This volume may then be designated by the user as a geologic target based on the geologic information.

Those skilled in the art will appreciate that the volume (and/or geological target) may be designated by the user based on a variety of geologic information (e.g., porosity, permeability, etc.). For example, the user may be presented with a number of potential volumes and then designate a geologic target from the volumes based on their corresponding geologic information.

The well target may then be obtained (ST 604) based on the geologic target and the geologic information. The well target may correspond to a subset of the volume associated with the geologic target. In this case, the user may interact with the display unit (416 in FIG. 5) to specify the well target. Specifically, the user may specify a subset of the volume associated with the geologic target using the display unit to obtain the well target (416 in FIG. 5). Further, the subset of the volume associated with the geologic target may be specified based on the geologic information (e.g., region of volume with highest porosity, etc.). In another example, the modeling unit (448 on FIG. 5) may specify the well target automatically based on the geologic target and geologic information.

Optionally, the user may also provide a confidence factor associated with the well target. The confidence factor may correspond to positional uncertainty of the wellbore at the depth of the well target during a drilling operation.

Next, the well trajectory may be obtained based on the well target (ST 606). The modeling unit (448 on FIG. 5) may generate the well trajectory based, in part, on the well target. In another example, the user may generate the well trajectory based on the well target and then send the well trajectory to the interface (430 on FIG. 5) using the display unit (416 on FIG. 5). The well trajectory may be defined as a second volume by the processing modules (442 in FIG. 5). The second volume may also be presented as output.

The drilling tool may then be advanced based on the well trajectory (ST 608) by a variety of methods. The user may advance the drilling tool using the controller (414 on FIG. 5) based on the well trajectory. The data rendering module may re-calculate the rendering algorithm to adjust the well trajectory display in real-time. A desired course of action may be determined based on the updated display to adjust the drilling operation.

The steps of the method in FIG. 6 are depicted in a specific order. However, it will be appreciated that the steps may be performed simultaneously or in a different order or sequence.

Figure 7:
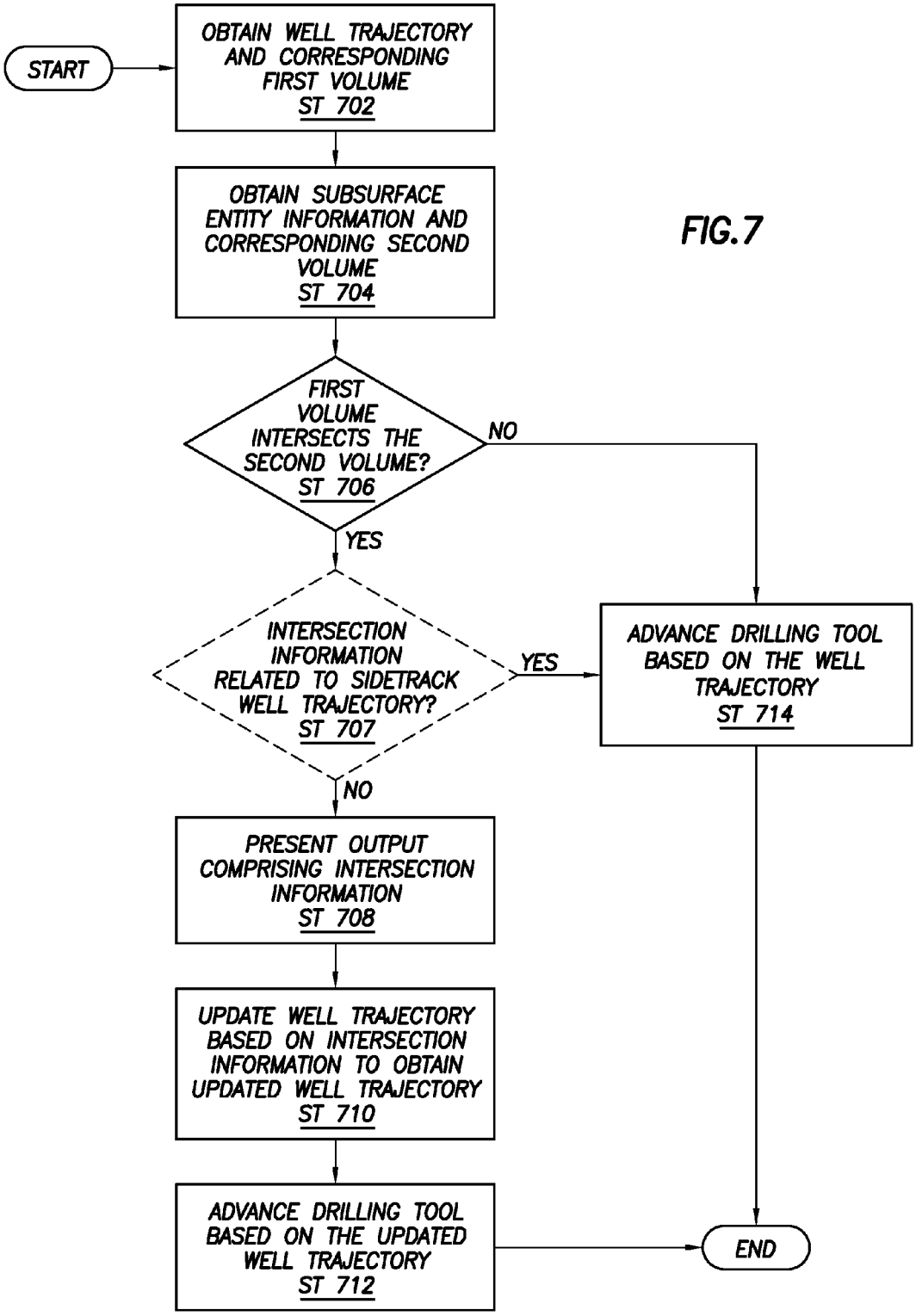

FIG. 7 shows a flow chart depicting a method for performing a drilling operation of an oilfield. The method may be performed using, for example, the system of FIG. 5.

The method involves obtaining a well trajectory and a corresponding first volume (ST 702), obtaining subsurface entity information and a corresponding second volume (ST 704), determining whether the first volume intersects the second volume (ST 706), presenting output comprising intersection information if the first volume intersects the second volume (ST 708), updating the well trajectory based on the intersection information to obtain an updated well trajectory (ST 710), and advancing the drilling tool based on the updated well trajectory (ST 712).

The well trajectory and corresponding first volume may be obtained (ST 702) from a variety of sources. For example, the well trajectory may be obtained as described in ST 602-ST 606 in FIG. 6 above. In another example, the well trajectory may be sent to the interface (430 in FIG. 5) or retrieved from a data repository (434 on FIG. 5). The well trajectory may correspond to a planned well trajectory. Next, the first volume may be obtained by the processing module (442 in FIG. 5) based on the well trajectory. The first volume may describe the uncertainty associated with the well trajectory. Further, the first volume may then be presented as output. Specifically, the output may be provided by the data rendering unit (436 in FIG. 5) in the modeling tool and presented to a user at the display unit (416 in FIG. 5) in the surface unit.

Optionally, the first volume may be updated. For example, the first volume may be updated based on anti-collision rules (e.g., a separation factor, a preferred angle at a well target, a maximum possible extent, or a preferred extent). Alternatively, the first volume may be updated when the well trajectory is updated.

The subsurface entity information and corresponding second volume may be obtained (ST 704) from a variety of sources. As discussed with respect to FIGS. 3 and 5, subsurface entity information may be generated by sensors (S) at the wellsite or from other sources. The subsurface entity information may be transferred directly to the modeling tool (408 in FIG. 5), or transferred to the modeling tool via at least one of the servers (406 in FIG. 5). The subsurface entity information is then generally received by the interface of the modeling tool. The second volume may then be obtained by the processing module (442 in FIG. 5) based on the subsurface entity information. The second volume may describe a separation factor associated with the subsurface entity. In another example, the second volume may describe a variety information associated with a subsurface entity (e.g., separation factor, uncertainty, or some other information capable of being defined as a volume). At this stage, the second volume may also be presented as output.

Next, a determination may be made as to whether the first volume intersects the second volume (ST 706). More specifically, a three dimensional relational comparison may be used by the modeling unit (448 in FIG. 5) to determine whether the first volume intersects the second volume. If the first volume does not intersect the volume, the drilling tool may be advanced based on the well trajectory (ST 714).

Optionally, a determination may be made as to whether the intersection data is associated with a sidetrack well trajectory (ST 707). Specifically, the subsurface entity may correspond to the sidetrack well trajectory. In this case, the well trajectory may not need to be updated based on the intersection information. Accordingly, the drilling tool may then be advanced based on the well trajectory (ST 714).

Next, if the first volume does intersect the second volume, output including intersection information may also be presented (ST 708). Specifically, the output may be presented to the user at the display unit (416 in FIG. 5). For example, the output may be presented in a tabular format displaying the intersection information. Optionally, presenting the output may also include identifying the intersection at the display unit (416 in FIG. 5). Specifically, identifying the intersection may include highlighting a volume portion associated with the first volume, where the volume portion intersects the second volume. In another example, only the volume portion associated with the first volume may be presented as output, where the presented volume portion intersects the second volume.

The well trajectory may be updated based on the intersection information to obtain an updated well trajectory (ST 710). The user may update the well trajectory based on the intersection information to obtain the updated well trajectory and then send the updated well trajectory to the interface (430 in FIG. 5). In another example, the user may update the well trajectory based on the intersection information using the display unit (416 in FIG. 5). In another example, the modeling unit (448 in FIG. 5) may automatically update the well trajectory based on the intersection information to obtain the updated well trajectory. The updated well trajectory may also be presented as output.

Those skilled in the art will appreciate that ST 706-ST 712 may be repeated any number of times until a determination is made that the well trajectory (i.e., first volume) does not intersect the subsurface entity (i.e., second volume). In other words, the well trajectory may be updated iteratively in ST 710 until the well trajectory no longer intersects the subsurface entity.

Next, the drilling tool may be advanced based on the updated well trajectory (ST 712). The user may advance the drilling tool using the controller (414 on FIG. 5) based on the updated well trajectory. The data rendering module may recalculate the rendering algorithm to adjust the updated well trajectory display in real time. A desired course of action may be determined based on the updated display to adjust the drilling operation.

The steps of the method in FIG. 7 are depicted in a specific order. However, it will be appreciated that the steps may be performed simultaneously or in a different order or sequence.

Figure 8:
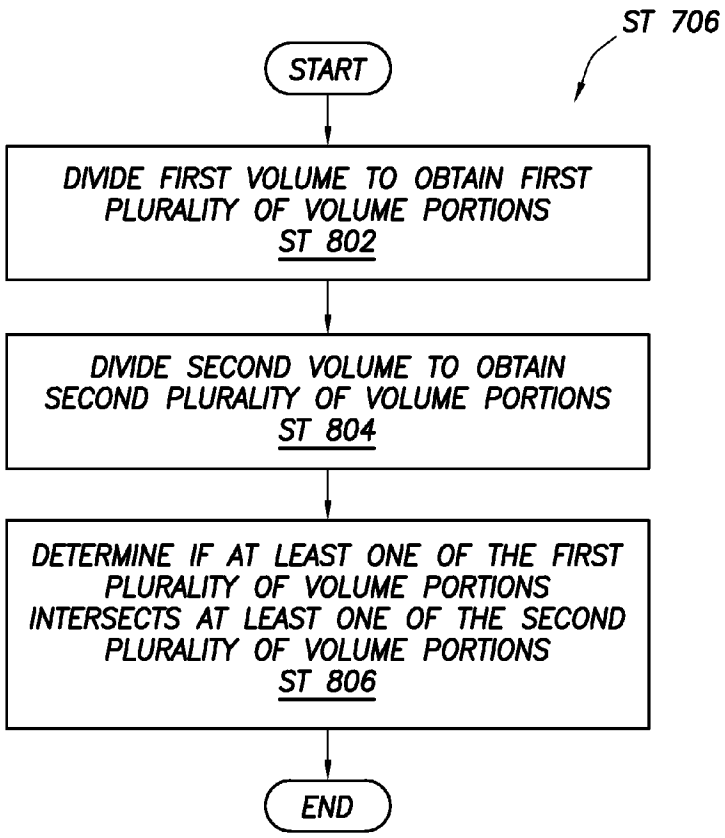

FIG. 8 shows a flow chart of a method for determining if a first volume intersects a second volume. The method may be performed using, for example, the system of FIG. 5. Further, the method may describe the determination step as discussed above in ST 706 of FIG. 7.

The method involves dividing the first volume to obtain a first plurality of volume portions (ST 802), dividing the second volume to obtain a second plurality of volume portions (ST 804), and determining at least one of the first plurality of volume portions, which intersects with at least one of the second plurality of volume portions (ST 806).

The first volumes may be divided into the first plurality of volume portions (ST 802) by a variety of methods. If the first volume is associated with a well trajectory, the first volume may be divided based on well trajectory stations associated with the well trajectory to obtain the first plurality of volume portions. Alternatively, the first volume may be divided into regular sized volumes based on a user-defined preference to obtain the first plurality of volume portions. Similar to the first volume, the second volume may also be divided into the second plurality of volume portions (ST 804) as discussed in above ST 802.

Next, a determination may be made regarding whether at least one of the first plurality of volume portions intersects with at least one of the second plurality of volume portions (ST 806). More specifically, each of the first plurality of volume portions may be compared to each of the second plurality of volume portions in an iterative process. Further, if it is determined that one of the first plurality of volume intersects one of the second plurality of volume portions, it may be determined that the first volume intersects the second volume, and the process may end.

The steps of the method in FIG. 8 are depicted in a specific order. However, it will be appreciated that the steps may be performed simultaneously or in a different order or sequence.

FIG. 9 shows a flow chart of a method for determining which of the at least one of a first plurality of volume portions intersects at least one of a second plurality of volume portions. The method may be performed using, for example, the system of FIG. 5. Further, the method may describe the determination step discussed above in ST 806 of FIG. 8.

The method involves defining a first bounding shape comprising one of a first plurality of volume portions (ST 902), defining a second bounding shape comprising one of a second plurality of volume portions (ST 904), determining the first bounding shape intersects the second bounding shape (ST 906), obtaining a first triangle associated with the one of the first plurality of volume portions (ST 908), obtaining a second triangle associated with the one of the second plurality of volume portions (ST 910), determining that the first triangle intersects the second triangle (ST 912), collecting intersection information for the one of the first plurality of volume portions and for the one of the second plurality of volume portions (ST 914).

The first bounding shape comprising one of a first plurality of volume portions may be defined (ST 902). The first bounding shape may correspond to a variety of shapes. For example, the first bounding shape may correspond to a cylinder, a sphere, a box, a cone, a cube, a spheroid, or some other regular or irregular three-dimensional polygon. Further, the one of a first plurality of volume portions may comprise of a first plurality of triangles. The second bounding shape comprising one of a second plurality of volume portions may then be defined (ST 904). Similar to the first bounding shape, the second bounding shape may correspond to a variety of shapes as discussed in ST 902 above. Further, the one of a second plurality of volume portions may comprise of a second plurality of triangles.

Next, a determination may be made as to whether the first bounding shape intersects the second bounding shape (ST 906). If the first bounding shape does not intersect the second bounding shape, then it is determined that the volume portions do not intersect and the process ends. Those skilled in the art will appreciate that the bounding shapes may be much simpler then their corresponding volume portions. Accordingly, the bounding shapes may be used to rapidly determine whether their corresponding volume portions do not intersect without requiring an expensive comparison of the triangles contained in the corresponding volume portions.

If the first bounding shape does intersect the second bounding shape, then a first triangle of the first plurality of triangles may be obtained (ST 908). Further, a second triangle of the second plurality of triangles may also be obtained (ST 910).

At this stage, a determination may be made as to whether the first triangle intersects the second triangle (ST 912). If the first triangle does intersect the second triangle, then it may be determined whether the corresponding volume portions intersect. Further, intersection information for the one of the first plurality of volume portions and for the one of the second plurality of volume portions may be collected (ST 914). Intersection information may include a reference to a first subsurface entity associated the one of the first plurality of volume portions, a reference to a second subsurface entity associated the one of the second plurality of volume portions, coordinate information related to the one of the first plurality of volume portions, and/or coordinate information related to the one of the second plurality of volume portions. Optionally, the one of the first plurality of volume portions may be highlighted at the display unit (416 in FIG. 5).

If the first triangle does not intersect the second triangle, then Steps 908-912 may be repeated until one of the first plurality of triangles is determined to intersect one of the second plurality of triangles or until each triangle of the first plurality of triangles has been determined to not intersect each triangle of the second plurality of triangles.

The steps of the method in FIG. 9 are depicted in a specific order. However, it will be appreciated that the steps may be performed simultaneously or in a different order or sequence.

Figure 10:
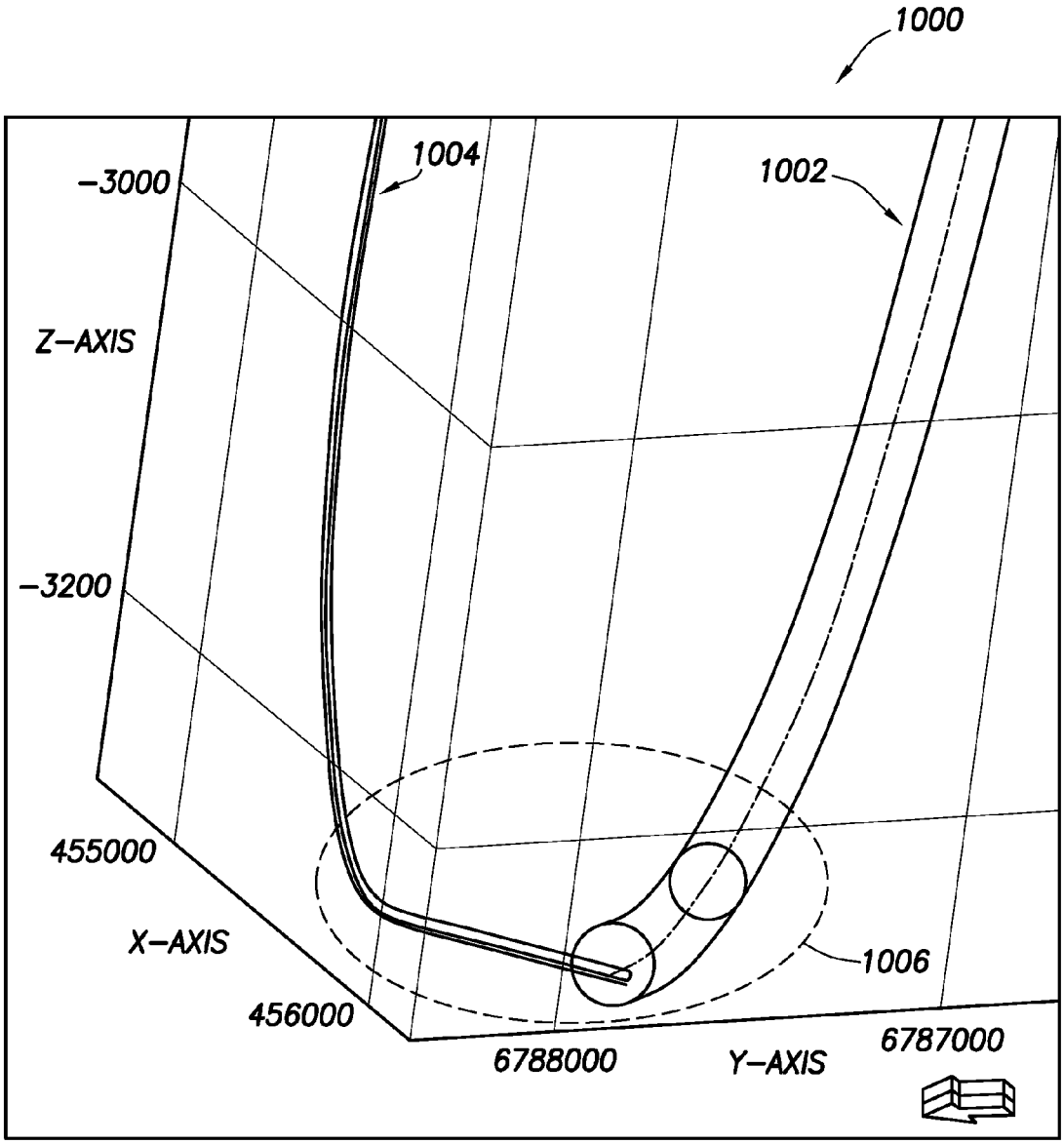
FIG. 10 shows an exemplary representation of intersection information in a graphical format.

FIG. 10 shows an exemplary graphical representation of output (1000) as described in ST 708 of FIG. 7 above. Here, the graphical representation includes a first volume (1002) and a second volume (1004). For example, the first volume may define a volume of uncertainty associated with a first well trajectory, and the second volume may define a volume of uncertainty associated with a second well trajectory. Further, a first volume portion associated with the first volume and a second volume portion associated with the second volume may be identified by highlighting the first volume portion and the second volume portion based on intersection information (1006) as described in ST 708 of FIG. 7.

Figure 11:
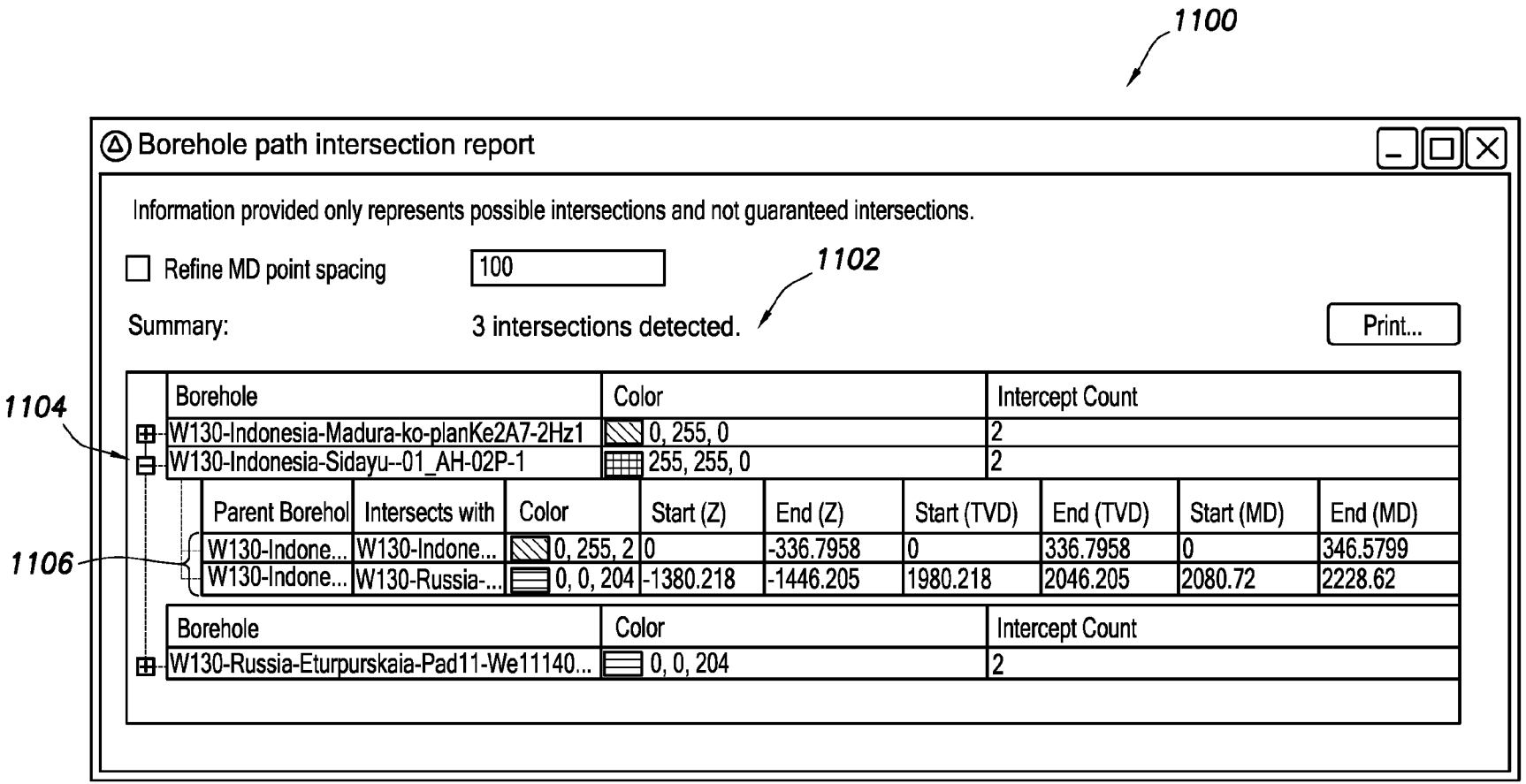
FIG. 11 shows an exemplary representation of intersection information in a tabular format.

FIG. 11 shows an exemplary tabular representation of output (1100) as collected at ST 914 in FIG. 9. The output (1100) includes intersection information related to a number of subsurface entities. More specifically, the output (1100) specifies that three intersections (1102) between subsurface entities have been detected. Further, the output (1100) includes an entry for each of the three subsurface entities (e.g., 1104), where each entry (e.g., 1104) specifies a variety of subsurface entity information (e.g., subsurface entity, symbol for displaying the subsurface entity, the number of intersections occurring with the subsurface entity, etc.). The details of each intersection (1106) may be displayed under their corresponding subsurface entity entry (e.g., 1104). The details of an intersection may specify a variety of intersection information (e.g., subsurface entities associated with the intersection, measured depth information, true vertical depth information, etc.). The output (1100) may be presented to the user in a display as described in ST 708 of FIG. 7 above.

Figure 12:
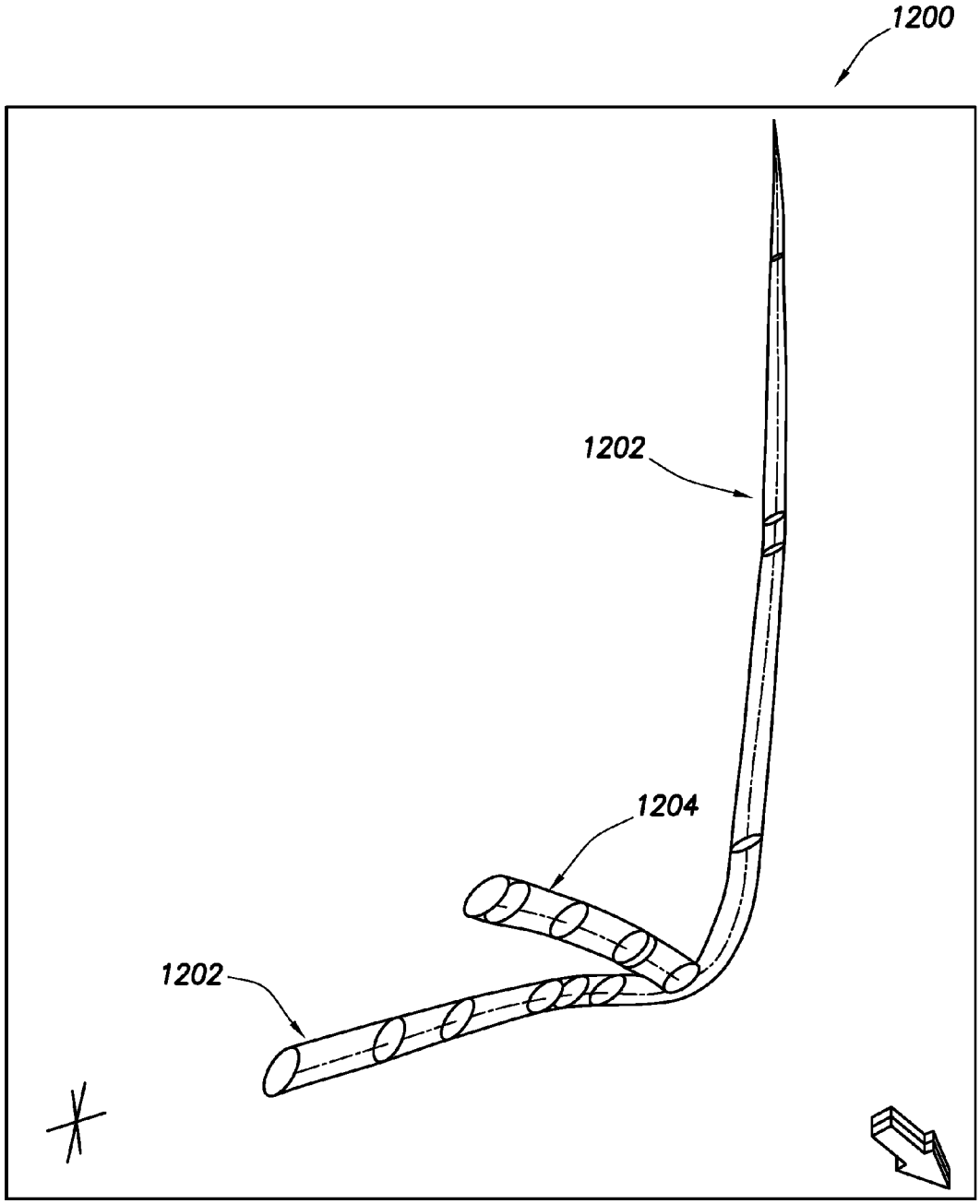
FIG. 12 shows an exemplary representation of a well trajectory and a sidetrack well trajectory associated with the well trajectory in a graphical format.

FIG. 12 shows an exemplary graphical representation of output (1200) including a well trajectory and a sidetrack well trajectory associated with the well trajectory. The graphical representation of output (1200) also includes a first volume (1202) associated with the well trajectory and a second volume (1204) associated with the sidetrack well trajectory. The first volume (1202) may describe uncertainty associated with the well trajectory. The second volume (1204) may describe uncertainty associated with the sidetrack well trajectory originating at the well trajectory.

It will be understood from the foregoing description that various modifications and changes may be made in the preferred and alternative embodiments of the present invention without departing from its true spirit. For example, the method may be performed in a different sequence, and the components provided may be integrated or separate.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for performing a drilling operation at a welisite having a drilling rig configured to advance a drilling tool into a subsurface, comprising:

obtaining a first well trajectory associated with a first three-dimensional (3D) volume;

obtaining information related to a first subsurface entity associated with a second 3D volume;

using a 3D relational comparison to determine that the first 3D volume intersects the second 3D volume to define a first intersection information, wherein the 3D relational comparison comprises:

dividing the first 3D volume into a first plurality of volume portions;

dividing the second 3D volume into a second plurality of volume portions; and determining that at least one of the first plurality of volume portions intersects at least one of the second plurality of volume portions;

updating the first well trajectory, based on the first intersection information, to obtain an updated well trajectory; and advancing the drilling tool into the subsurface based on the updated well trajectory.

2. The method of claim 1, wherein determining that the at least one of the first plurality of volume portions intersects the at least one of the second plurality of volume portions comprises:

defining a first bounding shape comprising one of the first plurality of volume portions, wherein the one of the first plurality of volume portions comprises a first plurality of triangles;

defining a second bounding shape comprising one of the second plurality of volume portions, wherein the one of the second plurality of volume portions comprises a second plurality of triangles;

determining that the first bounding shape intersects the second bounding shape;

determining that the at least one of the first plurality of triangles intersects the at least one of the second plurality of triangles; and collecting the first intersection information for the one of the first plurality of volume portions and for the one of the second plurality of volume portions.

3. The method of claim 2, wherein the first bounding shape corresponds to a shape selected from a group consisting of a cylinder, a sphere, a box, a cone, a cube, a spheroid, and a regular 3D polygon.

4. The method of claim 1, wherein obtaining the first well trajectory comprises:

obtaining a geologic target based on geologic information, wherein the geologic target is associated with a third 3D volume;

specifying a well target based on the geologic target and the geologic information associated with the geologic target, wherein the well target corresponds to a subset of the third 3D volume; and obtaining the first well trajectory based on the well target.

5. The method of claim 1, further comprising:

obtaining information associated with a second subsurface entity, wherein the second subsurface entity is associated with a third 3D volume;

determining that the first 3D volume intersects the third 3D volume using the 3D relational comparison to obtain second intersection information; and determining that the second intersection information is associated with a sidetrack well trajectory.

6. The method of claim 5, wherein the sidetrack well trajectory describes a sidetrack well originating along the first well trajectory.

7. The method of claim 1, wherein the first subsurface entity corresponds to at least one selected from a group consisting of a lease boundary, a political boundary, a geologic formation, a subsurface structure, a second well trajectory, and a wellbore.

8. The method of claim 1, wherein the first 3D volume comprises a 3D uncertainty volume corresponding to the uncertainty associated with the first well trajectory.

9. The method of claim 1, wherein the second 3D volume describes a 3D volume encompassing the first subsurface entity, wherein a separation factor defines a distance between a boundary of the first subsurface entity and a boundary of the second 3D volume.

10. The method of claim 1, further comprising:

updating the first 3D volume based on an anti-collision rule selected from a group consisting of a separation factor, a preferred angle at a well target, a maximum extent, and a preferred extent.

11. The method of claim 1, wherein the first well trajectory is associated with a planned well.

12. The method of claim 11, wherein the first subsurface entity corresponds to a second well trajectory, wherein the second well trajectory is associated with a historical well.

13. The method of claim 11, wherein the first subsurface entity corresponds to a second well trajectory, wherein the second well trajectory is associated with a second planned well.

14. The method of claim 1, further comprising:

generating output comprising at least one selected from a group consisting of the first well trajectory, the first subsurface entity, the first 3D volume, the second 3D volume, and the first intersection information; and presenting the output in a format corresponding to at least one selected from a group consisting of a tabular format and a graphical format.

15. The method of claim 14, wherein the output further comprises at least one selected from a group consisting of historical geologic data, real-time geologic data, and calculated geologic data.

16. A method of performing a drilling operation at a wellsite having a drilling rig configured to advance a drilling tool into a subsurface, comprising:

obtaining a geologic target based on geologic information, wherein the geologic target is associated with a first three-dimensional (3D) volume;

specifying a well target based on the geologic target and the geologic information associated with the geologic target, wherein the well target corresponds to a subset of the first 3D volume;

obtaining a well trajectory based on the well target, wherein the well trajectory is associated with a second 3D volume;

obtaining information associated with a subsurface entity, wherein the subsurface entity is associated with a third 3D volume;

determining that the second 3D volume intersects the third volume using a 3D relational comparison to obtain intersection information, wherein the 3D relational comparison comprises:

dividing the second 3D volume into a first plurality of volume portions; dividing the third 3D volume into a second plurality of volume portions; and determining that at least one of the first plurality of volume portions intersects at least one of the second plurality of volume portions;

updating the well trajectory, prior to advancing the drilling tool, based on the intersection information to obtain an updated well trajectory; and advancing the drilling tool into the subsurface based on the updated well trajectory.

17. The method of claim 16, wherein determining that the at least one of the first plurality of volume portions intersects the at least one of the second plurality of volume portions comprises:

defining a first bounding shape comprising one of the first plurality of volume portions, wherein the one of the first plurality of volume portions comprises a first plurality of triangles;

defining a second bounding shape comprising one of the second plurality of volume portions, wherein the one of the second plurality of volume portions comprises a second plurality of triangles;

determining that the first bounding shape intersects the second bounding shape;

determining that at least one of the first plurality of triangles intersects at least one of the second plurality of triangles; and collecting the intersection information for the one of the first plurality of volume portions and for the one of the second plurality of volume portions.

18. The method of claim 17, wherein the first bounding shape corresponds to a shape selected from a group consisting of a cylinder, a sphere, a box, a cone, a cube, a spheroid, and a regular 3D polygon.

19. The method of claim 16, wherein the subsurface entity corresponds to at least one selected from a group consisting of a lease boundary, a political boundary, a geologic formation, a subsurface structure, a second well trajectory, and a wellbore.

20. The method of claim 16, wherein the second 3D volume comprises a 3D uncertainty volume corresponding to the uncertainty associated with the well trajectory.

21. The method of claim 16, wherein the third 3D volume describes a 3D volume encompassing the subsurface entity, wherein a separation factor defines a distance between a boundary of the subsurface entity and a boundary of the second 3D volume.

22. The method of claim 16, wherein the well trajectory is associated with a planned well.

23. The method of claim 16, further comprising:

generating output comprising at least one selected from a group consisting of: the well trajectory, the subsurface entity, the first 3D volume, the second 3D volume, the third 3D volume, and the intersection information; and presenting the output in a format corresponding to at least one selected from a group consisting of a tabular format and a graphical format.

24. The method of claim 23, wherein the output further comprises at least one selected from a group consisting of historical geologic data, real-time geologic data, and calculated geologic data.

25. The method of claim 16, wherein the well target corresponds to a shape selected from a group consisting of a cylinder, a sphere, a box, a cone, a cube, a spheroid, and a regular 3D polygon.

26. A system for performing a drilling operation at a wellsite having a drilling rig configured to advance a drilling tool into a subsurface, comprising:

an interface configured to:

obtain a first well trajectory, wherein the first well trajectory is associated with a first three-dimensional (3D) volume; and obtain information associated with a first subsurface entity, wherein the first subsurface entity is associated with a second 3D volume; and a modeling unit configured to:

determine that the first 3D volume intersects the second 3D volume using a 3D relational comparison to obtain first intersection information, wherein the 3D relational comparison is performed by:

dividing the first 3D volume into a first plurality of volume portions;

dividing the second 3D volume into a second plurality of volume portions; and determining that at least one of the first plurality of volume portions intersects at least one of the second plurality of volume portions; and update the first well trajectory, based on the first intersection information, to obtain an updated well trajectory.

27. The system of claim 26, wherein determining that the at least one of the first plurality of volume portions intersects the at least one of the second plurality of volume portions comprises:

defining a first bounding shape comprising one of the first plurality of volume portions, wherein the one of the first plurality of volume portions comprises a first plurality of triangles;

defining a second bounding shape comprising one of the second plurality of volume portions, wherein the one of the second plurality of volume portions comprises a second plurality of triangles;

determining that the first bounding shape intersects the second bounding shape;

determining that at least one of the first plurality of triangles intersects at least one of the second plurality of triangles; and collecting the first intersection information for the one of the first plurality of volume portions and for the one of the second plurality of volume portions.

28. The system of claim 27, wherein the first bounding shape corresponds to a shape selected from a group consisting of a cylinder, a sphere, a box, a cone, a cube, a spheroid, and a regular 3D polygon.

29. The system of claim 26, wherein obtaining the first well trajectory comprises:

obtaining a geologic target based on geologic information, wherein the geologic target is associated with a third 3D volume;

specifying a well target based on the geologic target and the geologic information associated with the geologic target, wherein the well target corresponds to a subset of the third 3D volume; and obtaining the first well trajectory based on the well target.

30. The system of claim 26, wherein:

the interface is further configured to:

obtain information associated with a second subsurface entity, wherein the second subsurface entity is associated with a third 3D volume; and the modeling unit is further configured to:

determine that the first 3D volume intersects the third 3D volume using the 3D relational comparison to obtain second intersection information, and determine that the second intersection information is associated with a sidetrack well trajectory.

31. The system of claim 30, wherein the sidetrack well trajectory describes a sidetrack well originating along the first well trajectory.

32. The system of claim 26, wherein the first subsurface entity corresponds to at least one selected from a group consisting of a lease boundary, a political boundary, a geologic formation, a subsurface structure, a second well trajectory, and a wellbore.

33. The system of claim 26, wherein the first 3D volume comprises a 3D uncertainty volume corresponding to the uncertainty associated with the first well trajectory.

34. The system of claim 26, wherein the second 3D volume describes a 3D volume encompassing the first subsurface entity, wherein a separation factor defines a distance between a boundary of the first subsurface entity and a boundary of the second 3D volume.

35. The system of claim 26, wherein the modeling unit is further configured to:

update the second 3D volume based on an anti-collision rule selected from a group consisting of a separation factor, a preferred angle at a well target, a maximum extent, and a preferred extent.

36. The system of claim 26, wherein the first well trajectory is associated with a planned well.

37. The system of claim 36, wherein the first subsurface entity corresponds to a second well trajectory, wherein the second well trajectory is associated with a historical well.

38. The system of claim 36, wherein the first subsurface entity corresponds to a second well trajectory, wherein the second well trajectory is associated with a second planned well.

39. The system of claim 36, further comprising:

a data rendering unit configured to:

generate output comprising at least one selected from a group consisting of the first well trajectory, the subsurface entity, the first 3D volume, the second 3D volume, and the first intersection information; and a display unit configured to:

present the output in a format corresponding to at least one selected from a group consisting of a tabular format and a graphical format.

40. The system of claim 39, wherein the output further comprises at least one selected from a group consisting of historical geologic data, real-time geologic data, and calculated geologic data.

* * * * *